US007322408B2

(12) United States Patent
Howlett

(10) Patent No.: US 7,322,408 B2
(45) Date of Patent: Jan. 29, 2008

(54) DOWNHOLE TOOL WITH ACTUABLE BARRIER

(75) Inventor: Paul David Howlett, Aberdeen (GB)

(73) Assignee: Specialised Petroleum Services Group Ltd., Westhill, Aberdeen (GB)

( * ) Notice: Subject to any disclaimer, the term of this patent is extended or adjusted under 35 U.S.C. 154(b) by 0 days.

(21) Appl. No.: 10/537,925

(22) PCT Filed: Dec. 8, 2003

(86) PCT No.: PCT/GB03/05337

§ 371 (c)(1),
(2), (4) Date: Mar. 6, 2006

(87) PCT Pub. No.: WO2004/053290

PCT Pub. Date: Jun. 24, 2004

(65) Prior Publication Data

US 2006/0169463 A1 Aug. 3, 2006

(30) Foreign Application Priority Data

Dec. 9, 2002 (GB) ..... 0228645.8

(51) Int. Cl.
*E21B 33/12* (2006.01)

(52) U.S. Cl. ..... 166/194; 166/99; 166/193

(58) Field of Classification Search ..... 166/99, 166/193, 194, 187
See application file for complete search history.

(56) References Cited

U.S. PATENT DOCUMENTS

| | | | | |
|---|---|---|---|---|
| 2,638,988 | A * | 5/1953 | Williams | 166/99 |
| 6,382,319 | B1 * | 5/2002 | Hill et al. | 166/278 |
| 6,431,273 | B1 | 8/2002 | McGarian et al. | |
| 6,607,031 | B2 * | 8/2003 | Lynde et al. | 166/99 |
| 2002/0162655 | A1 | 11/2002 | Lynde et al. | |

FOREIGN PATENT DOCUMENTS

| | | |
|---|---|---|
| GB | 2335687 | 9/1999 |

* cited by examiner

*Primary Examiner*—David Bagnell
*Assistant Examiner*—Giovanna M Collins
(74) *Attorney, Agent, or Firm*—C. Dean Domingue; Robert L. Waddell; Ted M. Anthony

(57) ABSTRACT

A downhole tool for use in a cased or lined well bore (40), the tool including a barrier (36) arranged on an outer surface of the tool. The barrier may be of a resilient material so that it can be deformed on actuation to control the passage of fluid between the tool and the casing or liner. Fluid flow is thus selectively diverted through flow paths (22) in the tool. Embodiments are described for actuating the barrier by hydraulic means and for filtering the fluid within the flow paths.

19 Claims, 3 Drawing Sheets

DOWNHOLE TOOL WITH ACTUABLE BARRIER

CROSS-REFERENCE TO RELATED APPLICATIONS

This patent application claims priority from PCT/GB03/05337, having an international filing date of 8 Dec. 2003, and a priority date of 9 Dec. 2002.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

The present invention relates to downhole tools for use in cased or lined well bores for the oil and gas industry, and in particular to a downhole tool which includes a barrier between the tool body and well bore wall which is actuable to control fluid flow past the tool.

It is considered desirable when drilling for oil or gas to maintain a clean interior in the casing or liner of the drilling well. For this purpose, well cleaning equipment is well known and comes in a variety of different forms, including casing scrapers, brushes and circulation tools. Such equipment is used to free the well tubing from debris particles, cement lumps, rocks, congealed mud and so on.

Indeed well clean-up apparatus is used in an attempt to clean the casing or other well tubing of even smaller particles or debris such as oxidation lumps, scale and burrs for example.

More advanced clean-up tools have also been developed which filter the well fluid downhole. This is done to remove the debris prior to production of the well. Such filtering tools generally operate by providing a barrier in the annulus between the tool body and the wall of the well casing or liner. The barrier causes diversion of fluid flowing past the tool into the tool. Once inside the tool the fluid is passed through a filter and then directed back into the annulus on the opposite side of the barrier. Such a tool is that disclosed in GB 2335687.

A major disadvantage of these tools is that, as filtering is required in one flow direction through the tool, a second flow path through the tool must be provided for fluid flow in the opposite direction so that the tool can be run in and/or pulled out of the well bore without re-dispersing the collected debris. This additional flow path restricts the volume of fluid which can pass the tool and may be prone to clogging if unfiltered well fluid is required to take this flow path on running in.

It is an object of the present invention to provide a downhole tool which allows for selective bypass of fluid around the outer body of the tool.

It is a further object of at least one embodiment of the present invention to provide a downhole tool with an actuable barrier which can be used to selectively divert fluid through the tool body.

It is a yet further object of at least one embodiment of the present invention to provide a downhole tool with an actuable barrier which can be used to selectively divert fluid passing the tool body through the tool body when the tool is run-in, pulled out or is stationary within the well bore.

BRIEF SUMMARY OF THE INVENTION

According to a first aspect of the present invention there is provided a downhole tool for use in a cased or lined well bore, the tool comprising a body connectable in a work string, a fluid flow path through the tool body and a barrier located at an outer surface of the tool, wherein the barrier is actuable to control fluid flow passing the tool and selectively divert fluid flow through the flow path.

When the barrier is not actuated the tool allows fluid flow to run unimpeded in the annulus between the tool body and the wall of the well bore. Conversely, the barrier may be actuated to cause passage of fluid through the tool.

Preferably the barrier comprises a resilient member which when acted upon by actuating means deforms to extend the member towards a wall of the well bore. The resilient member may be a rubber ball. Alternatively the resilient member may be an inflatable bladder.

Advantageously the barrier includes a surface engageable with the well casing or liner. The surface may provide a seal such that fluid is substantially restricted from passing the tool. Thus the barrier is circumferentially arranged on the outer surface of the tool body. Further the barrier may be rotatable with respect to the tool body. Advantageously also the surface is a wiper so that as the tool is moved within the well bore the casing or liner is cleaned when the surface is engaged.

Preferably the actuating means is a hydraulic actuator. Hydraulic fluid may flow directly against the resilient member to cause deformation. Alternatively the fluid may act upon a piston member, wherein movement of the piston member causes the resilient member to deform. In a first embodiment the resilient member may be initially held in compression by a retainer and the piston member releases the retainer.

Advantageously, well fluid within the well bore may be the hydraulic fluid to operate the actuating means.

Alternatively the actuating means may include a ball valve. Thus the barrier may become actuable through a drop ball released at the surface and carried through a bore in the work string. To selectively actuate the barrier the drop ball may be deformable as are known in the art. This is as disclosed in WO02/061236 for example.

The work string may be a pipe string, coiled tubing or a wireline.

Preferably the tool includes an axial bore for fluid circulation through the work string. Preferably also the tool body is substantially cylindrical to provide the annulus between the tool and the wall of the well bore.

There may be a plurality of fluid flow paths through the tool body. One or more of the fluid flow paths may include a filter so that well fluid can be filtered downhole. Alternatively the fluid flow path may form a hydraulic line for the actuation of a feature of the downhole tool. Preferably the fluid flow path has an inlet and an outlet. Preferably the inlet and outlet are each arranged on an outer surface of the tool. Preferably also the inlet and outlet are arranged on either side of the barrier.

According to a second aspect of the present invention there is provided a downhole tool for collecting loose debris particles within a well bore, the tool comprising a body connectable in a work string, a fluid flow path through the tool body including means for filtering debris particles and a barrier located at an outer surface of the tool, wherein the barrier is actuable to control fluid flow passing the tool and selectively divert fluid flow through the flow path.

The filtration means may be a wire screen sized to prevent particles of a predetermined size from passing therethrough. It will be appreciated however that many different types of filtration apparatus may be used, including permeable textiles, holed tubes or cages, and so on. The filtration means need not be limited to any one particular type of screen or filter, but may rather comprise of a plurality of filters in series; the filters being potentially of varying type and permeability.

The tool may also act as a collector or trap for debris and the like. For example, a trap may be provided on the up-stream side of the filter means for storing the filtered debris.

Optionally, a separate filter may be provided for each filtered flow path.

Preferably the barrier comprises a resilient member which when acted upon by actuating means deforms to extend the member towards a wall of the well bore. The resilient member may be a rubber ball. Alternatively the resilient member may be an inflatable bladder.

Advantageously the barrier includes a surface engageable with the well casing or liner. The surface may provide a seal such that fluid is substantially restricted from passing the tool. Thus the barrier is circumferentially arranged on the outer surface of the tool body. Further the barrier may be rotatable with respect to the tool body. Advantageously also the surface is a wiper so that as the tool is moved within the well bore the casing or liner is cleaned when the surface is engaged.

Preferably the actuating means is a hydraulic actuator. Hydraulic fluid may flow directly against the resilient member to cause deformation. Alternatively the fluid may act upon a piston member, wherein movement of the piston member causes the resilient member to deform. In a first embodiment the resilient member may be initially held in compression by a retainer and the piston member releases the retainer.

Advantageously, well fluid within the well bore may be the hydraulic fluid to operate the actuating means.

Alternatively the actuating means may include a ball valve. Thus the barrier may become actuable through a drop ball released at the surface and carried through a bore in the work string. To selectively actuate the barrier the drop ball may be deformable as are known in the art. This is as disclosed in WO02/061236.

The work string may be a pipe string, coiled tubing or a wireline.

Preferably the tool includes an axial bore for fluid circulation through the work string. Preferably also the tool body is substantially cylindrical to provide the annulus between the tool and the wall of the well bore.

There may be a plurality of fluid flow paths through the tool body. Preferably the/each fluid flow path has an inlet and an outlet. Preferably the inlet and outlet are each arranged on an outer surface of the tool. Preferably also the inlet and outlet are arranged on either side of the barrier.

According to a third aspect of the present invention there is provided a method of controlling fluid flow in a well bore, comprising the steps:

(a) running a tool having an actuable barrier on a work string downhole;
(b) creating relative movement between the fluid in the well bore and the tool;
(c) actuating the barrier to control fluid flow passing the tool by varying the cross sectional area of the annulus between the tool and the wall of the well bore.

The method may further include the step of selectively diverting fluid flow through a flow path in the tool.

Preferably the method may include the step of actuating the barrier until the barrier sealingly engages the wall of the well bore and thus substantially restricts fluid flow passing the tool.

Additionally the method may include the step of filtering the fluid flow through the flow path in the tool.

BRIEF DESCRIPTION OF THE DRAWINGS

Embodiments of the present invention will now be described, by way of example only, with reference to the accompanying drawings of which.

DETAILED DESCRIPTION OF THE INVENTION

Figure 1:
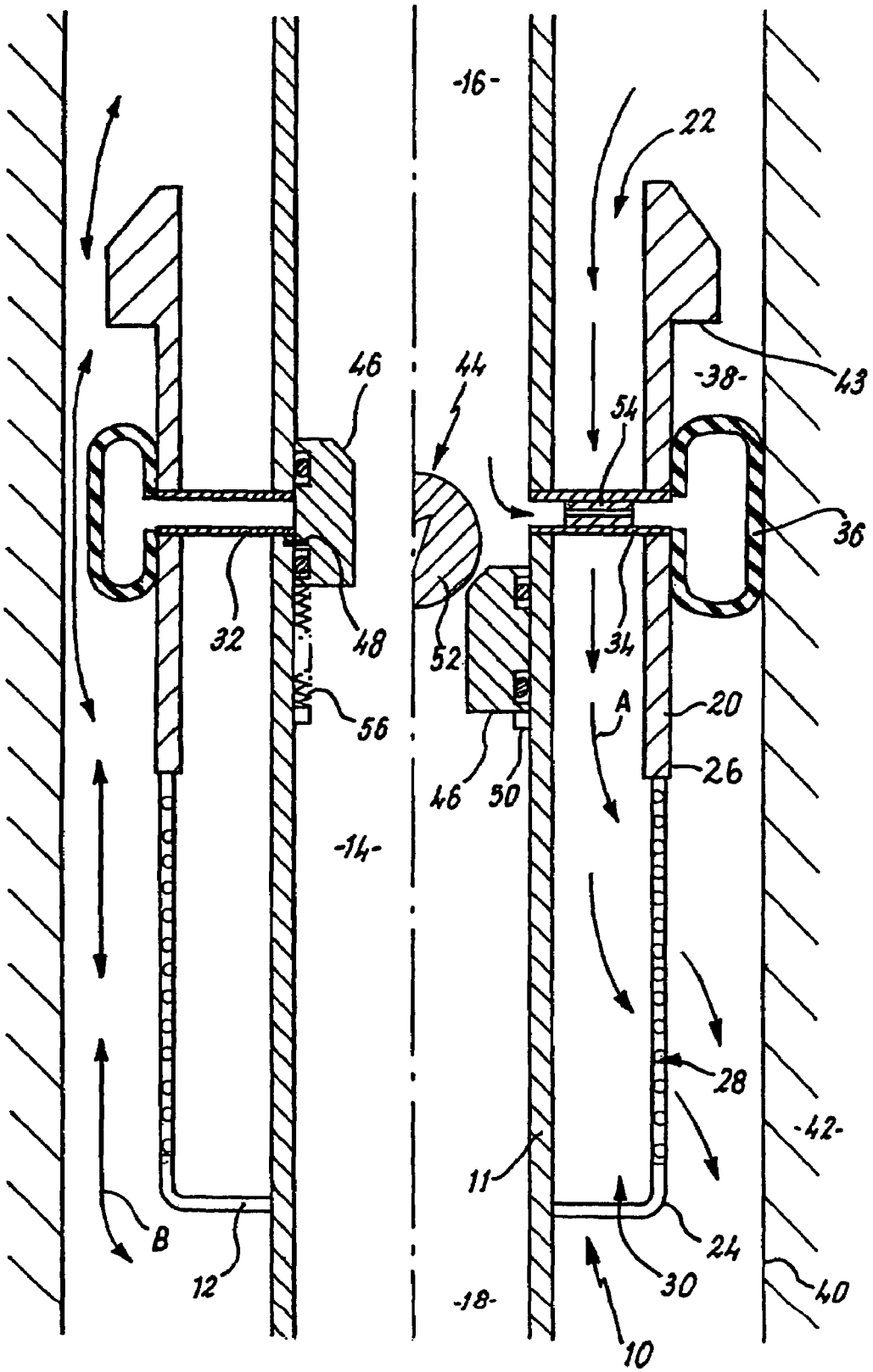
FIG. 1 is a part cross-sectional view through a downhole tool according to a first embodiment of the present invention.

Reference is initially made to FIG. 1 of the drawings, which illustrates a downhole tool, generally indicated by reference numeral 10, according to a first embodiment of the present invention. Tool 10 comprises a generally cylindrical body 12 having an axial bore 14 therethrough. At an upper end 16 of the tool 10 there is provided a box section (not shown) and at the lower end 18 of the tool 10 there is a pin section (not shown), as are known in the art, for connecting the tool 10 to a work string (not shown).

Around an inner mandrel 11 of the body 12 there is located a sleeve 20. Sleeve 20 provides an inlet port 22 of annular shape at the upper end 16 of the tool 10. At the lower end 18 is arranged a stop surface 24 to join the sleeve 20 to the mandrel 11. In a portion of the wall 26 of the sleeve 20, towards the lower end 18, there is a filter 28. Filter 28 is a cylindrical screen which can filter loose debris and particles from fluid passing through it. Together the sleeve 20 with filter 28 and stop 24 provide a trap 30 where debris will collect when fluid flow is in a direction marked by arrows A.

Between the mandrel 11 and the sleeve 20 are located ports 32. Although a single port 32 is shown, typically there will be a number of ports symmetrically arranged around the mandrel 11. However sufficient space around the ports 32 is provided for the entry of larger pieces of debris to the trap 30. Mounted at an outlet 34 of the port 32 is an inflatable seal 36. Seal 36 is circumferentially arranged around the sleeve 20. Seal 36 is made of a resilient rubber which when inflated from the inside will increase the size of the seal to fill the annular space 38 between the tool 10 and the casing/liner wall 40 of the well bore 42. When deflated the seal 36 is afforded some protection by a lip 43 on sleeve 20 which directs fluid toward the casing 40.

Within the mandrel is located a ball valve, generally indicated by reference numeral 44. Valve 44 comprises a seat 46 which is initially held to the mandrel 11 by a shear pin 48. A stop 50 is also provided on the mandrel 11.

In use, tool 10 is run in well bore 42 through casing 40 on a work string (not shown). As shown on the left hand side of FIG. 1, the seal 36 is initially deflated so fluid can flow upstream or downstream of the tool shown by arrows B. This provides a large circulation path for the fluid. Fluid can also flow through the axial bore 14 independently. Valve seat 46 is located across the port (s) 32 to prevent the seal inflating. The valve seat is held in position by the shear pin 48.

When fluid is required to be filtered, such as on pulling out the tool 10 from the well bore 42, a ball 52 is dropped from the surface into the axial bore 14. Ball 52 travels under fluid pressure to the seat 46 where it blocks the passage of fluid through the bore 14. Pressure then builds up behind the ball, sufficient to shear the pin 48 and move the seat 46 downwards. The seat 46 will fall to the stop 50, whereupon fluid within the bore can now flow through port 32 to outlet 34 and fill the seal 36. Seal 36 consequently expands by inflation to fill the annulus 38 and prevent fluid flow down the outside of the tool 10 between the sleeve 20 and the casing 40. The fluid flow to the seal 36 is regulated by a check valve 54 located in the port 32 to prevent over inflation of the seal 36.

Seal 36 now engages the casing 40, as shown in the right hand side of FIG. 1. Seal 36 has a surface which is suitable for continuous contact to the casing 40 while the tool is moved within the casing 40. This surface is typically a roughened rubber surface such as knobbles which reduce the surface contact area without reducing the quantity of fluid flow passed the tool 10. When tool 10 is moved, fluid is now directed into the annular port 22 and travels into the trap 30. The fluid is filtered by passing through filter 28 and the clean fluid exits the tool below the seal 36. Any debris filtered from the fluid is caught within the sleeve 20 and falls against stop 24 or is held in filter 28. Trap 30 can be emptied when the tool 10 is removed from the well bore 42.

If filtering is not required at any time, that is if the tool is to be further plunged into the well, fluid pressure is increased through the axial bore 14. As valve 54 is closed, the increased pressure acts upon the drop ball 52. Drop ball 52 is deformable and thus will be extruded through the seat 46 and fall through the axial bore 14. A ball catcher can be located further down the work string to retrieve the ball 52. When extruded the pressure drop in the bore 14 causes the check valve 54 to open and fluid is released from the seal 36. Seal 36 then deflates, just before spring 56 returns the valve seat 46 back over the port 32. The tool 10 is thus reset and seal 36 can be actuated as often as required by repeating the process.

Figure 2:
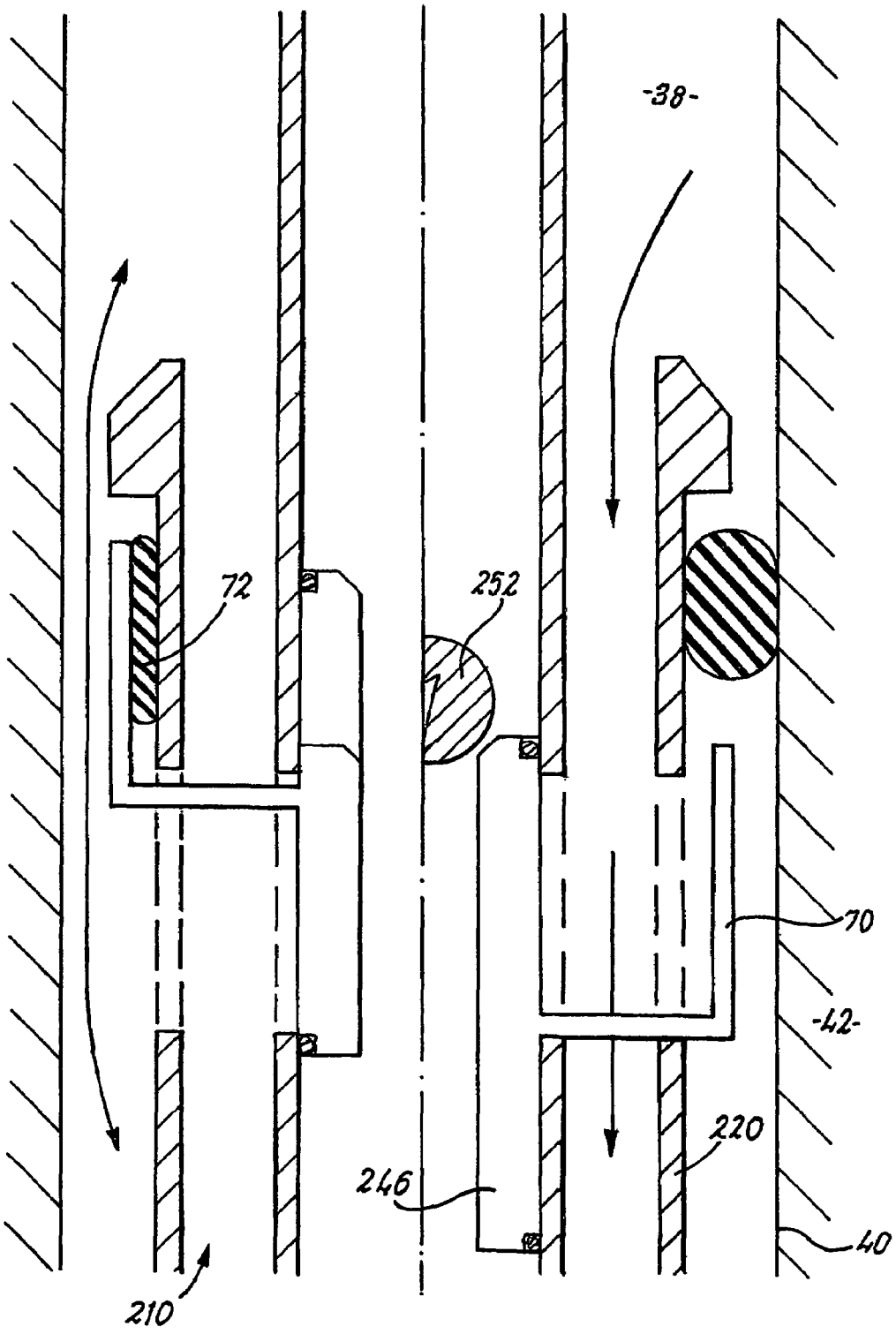
FIG. 2 is a part cross-sectional view through a downhole tool according to a second embodiment of the present invention.

Reference is now made to FIG. 2 of the drawings which illustrates a downhole tool, generally indicated by reference numeral 210, according to a second embodiment of the present invention. Like parts to those of FIG. 1 have been given the same reference numeral with the addition of 200. The filter and trap arrangement are included in the tool but are omitted from the Figure to provide better clarity to the sealing arrangement.

In this second embodiment the valve seat 246 extends through the sleeve 220 to provide a retainer cup 70 in the annulus. Engaging slots are provided between the sleeve 220 and the cup 70 to prevent a fluid path being provided at this position on the tool.

Initially the retainer cup 70 retains a rubber ring 72 against the sleeve 220 to provide the passage past the tool. On dropping the ball 252, to a similar ball valve arrangement, the cup 70 is moved downwards and the ring expands to fill the annulus 38. The tool 210 can then operate in an identical manner to the tool 10 of FIG. 1.

Figure 3:
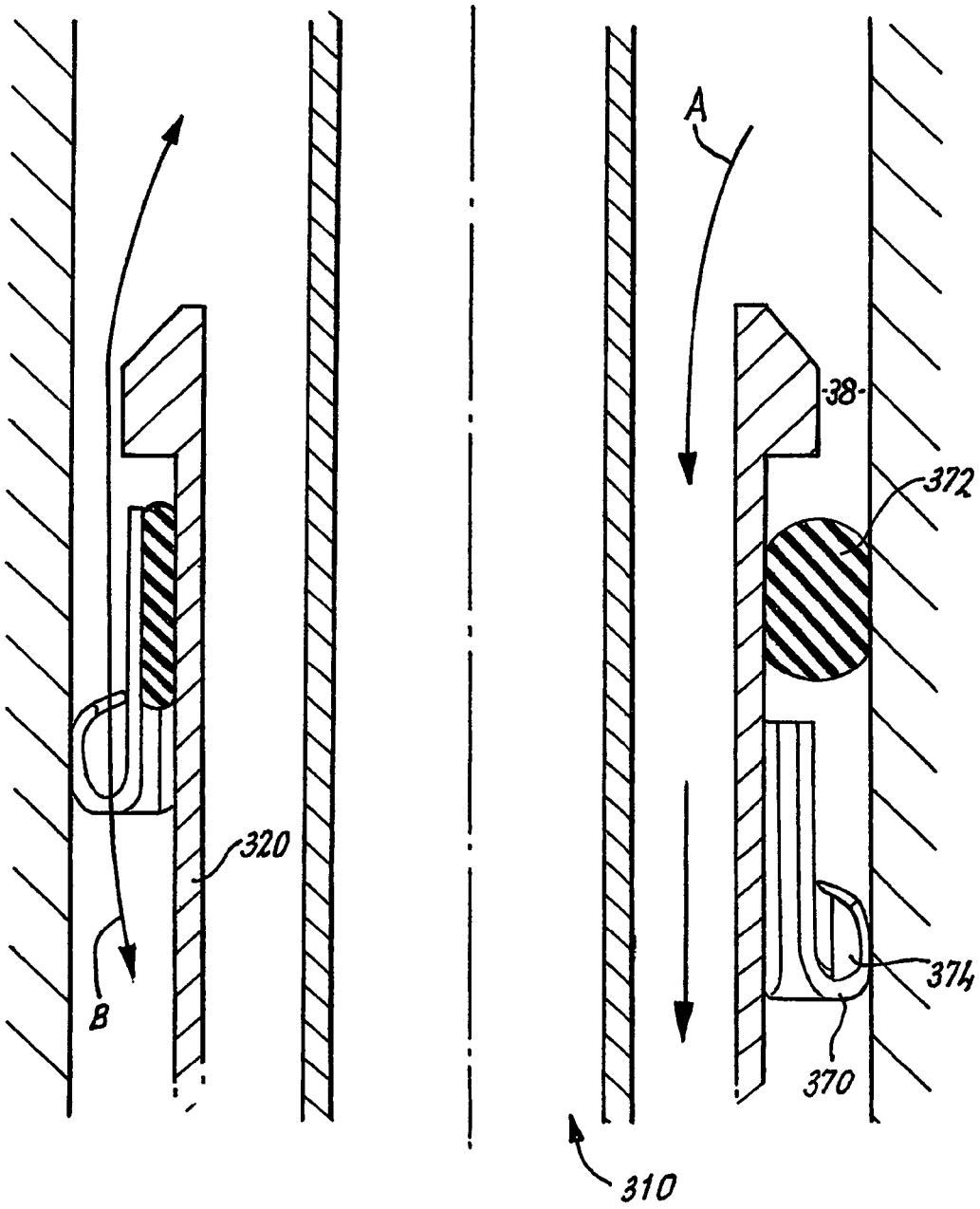
FIG. 3 is a part cross-sectional view through a downhole tool according to a third embodiment of the present invention.

Reference is now made to FIG. 3 of the drawings which illustrates a downhole tool, generally indicated by reference numeral 310, according to a third embodiment of the present invention. Like parts to those of FIG. 1 have been given the same reference numeral with the addition of 300.

In likeness to the previous example embodiment, the barrier in the embodiment of FIG. 3 is a rubber ring 372. The ring 372 is shown in a non-actuated position in the left hand section of the drawing, where it is compressed against sleeve 320 by a drag block 370. The drag block 370 is sufficiently slotted or ported so as to enable fluid to flow through it, yet nevertheless it is also adapted to undergo movement when drag forces resulting from a predetermined flow of fluid act on it. Thus in use, fluid can flow over the outside of the tool, by the route of arrow B. Here the ring 372 is compressed and held in position by the drag block 370. When fluid pressure is increased by a predetermined amount or, alternatively, the tool is pulled from the well bore, an increase in pressure will occur on the surface 374 of each drag block 370. Drag block 370 will then move relative to the tool 310 and the ring 372 will be released to expand and fill the annulus 38, thereby redirecting fluid flow through the tool in the direction of arrow A. The advantage of this embodiment is that the barrier is actuated by the well fluid and a second actuating fluid is not required.

The principal advantage of the present invention is that it provides a downhole tool wherein fluid passing the tool can be selectively diverted through the tool.

A further advantage of the present invention is that it provides a downhole tool wherein fluid can be filtered within a well bore when the tool is run in or pulled out of the well bore.

It will be appreciated by those skilled in the art that further modifications could be made to the invention herein described without departing from the scope thereof. For instance the ball valve could be released by inserting a smaller steel ball to block the port 32 to allow pressure to build up on the deformable ball 52.

The invention claimed is:

1. A downhole tool for use in a cased or lined well bore, the tool comprising:

a body connectable in a work string, the body having a fluid flow path therethrough;

a barrier comprising a resilient member, the barrier located at an outer surface of the tool; and a hydraulic actuator comprising a retainer and a piston member;

wherein the barrier is actuable to control fluid flow past the tool and to selectively divert fluid flow through the flow path;

and wherein the resilient member is initially held in compression by the retainer to allow fluid flow past the tool;

and further wherein the barrier is actuated by the piston member which releases the retainer to cause the resilient member to deform by expanding so that the resilient member extends towards a wall of the well bore to divert fluid flow through the flow path.

2. A downhole tool as claimed in claim 1 wherein the barrier includes a surface engageable with the well casing or liner to provide a seal such that fluid is substantially restricted from passing the tool.

3. A downhole tool as claimed in claim 2 wherein the surface is a wiper so that as the tool is moved within the well bore the casing or liner is cleaned when the surface is engaged.

4. A downhole tool as claimed in claim 1 wherein well fluid within the well bore acts as the hydraulic fluid to operate the actuating means.

5. A downhole tool as claimed in claim 1 wherein the hydraulic actuator includes a ball valve.

6. A downhole tool as claimed in claim 5 wherein the barrier is actuable through a drop ball released at the surface and carried through a bore in the work string and selectively actuable as the drop ball is deformable.

7. A downhole tool as claimed in claim 1 wherein the tool includes a plurality of fluid flow paths through the tool body.

8. A downhole tool as claimed in claim 7 wherein one or more of the fluid flow paths includes a filter so that well fluid can be filtered downhole.

9. A downhole tool as claimed in claim 7 wherein one or more of the fluid flow paths form a hydraulic line for the actuation of a feature of the downhole tool.

10. A downhole tool as claimed in claim 7 wherein the fluid flow paths have an inlet and an outlet arranged on an outer surface of the tool on either side of the barrier.

11. A downhole tool for collecting loose debris particles within a well bore, the tool comprising:

a body connectable in a work string, the tool body having a fluid flow path therethrough, the fluid flow path including means for filtering debris particles;

a barrier comprising a resilient member, the barrier located at an outer surface of the tool; and a hydraulic actuator comprising a retainer and a piston member;

wherein the barrier deforms on actuation to control fluid flow past the tool and to selectively divert fluid flow through the flow path;

and wherein the resilient member is initially held in compression by the retainer to allow fluid flow past the tool;

and further wherein the barrier is actuated by the piston member which releases the retainer to cause the resilient member to deform by expanding so that the resilient member extends towards a wall of the well bore to divert fluid flow through the flow path.

12. A downhole tool as claimed in claim 11 wherein the filtering means is a screen sized to prevent particles of a predetermined size from passing therethrough.

13. A downhole tool as claimed in claim 11 wherein the tool includes a trap for collecting debris.

14. A downhole tool as claimed in claim 11 wherein the resilient member is a rubber ball.

15. A downhole tool as claimed in claim 11 wherein the resilient member is an inflatable bladder.

16. A downhole tool as claimed in claim 11 wherein the barrier has a surface engageable with the well bore to provide a seal.

17. A method of controlling fluid flow in a well bore, comprising the steps:

(a) running a tool having an actuable barrier comprising a resilient member on a work string downhole;

(b) creating relative movement between the fluid in the well bore and the tool;

(c) initially holding the resilient member in compression using a retainer of a hydraulic actuator of the tool, to permit fluid flow past the tool along an annulus defined between the tool and a wall of the well bore;

(d) actuating a piston member of the hydraulic actuator to release the retainer, whereupon the resilient member deforms by expanding and extends towards the wall of the well bore to vary a cross sectional area of the annulus between the tool and the wall of the well bore, thereby controlling fluid flow past the tool and diverting fluid through a flow path in a body of the tool.

18. A method as claimed in claim 17 wherein the method includes the step of actuating the barrier until the barrier sealingly engages the wall of the well bore and thus substantially restricts fluid flow passing the tool.

19. A method as claimed in claim 17 wherein the method includes the step of filtering the fluid flowing through the flow path in the tool.

* * * * *